US009603209B2

(12) United States Patent
Fang et al.

(10) Patent No.: US 9,603,209 B2
(45) Date of Patent: Mar. 21, 2017

(54) LED DRIVER

(71) Applicants: Liang Fang, Peachtree City, GA (US); William Lee Shiley, Senoia, GA (US); James Moan, Peachtree City, GA (US); James Christopher Andrews, Mabelton, GA (US)

(72) Inventors: Liang Fang, Peachtree City, GA (US); William Lee Shiley, Senoia, GA (US); James Moan, Peachtree City, GA (US); James Christopher Andrews, Mabelton, GA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 14/845,111

(22) Filed: Sep. 3, 2015

(65) Prior Publication Data

US 2016/0073473 A1 Mar. 10, 2016

Related U.S. Application Data

(60) Provisional application No. 62/045,584, filed on Sep. 4, 2014.

(51) Int. Cl.
*H05B 37/02* (2006.01)
*H05B 33/08* (2006.01)

(52) U.S. Cl.
CPC ..... *H05B 33/0815* (2013.01); *H05B 33/0812* (2013.01); *H05B 33/0824* (2013.01); *H05B 33/0845* (2013.01); *H05B 33/0887* (2013.01); *H05B 37/02* (2013.01)

(58) Field of Classification Search
CPC .... H05B 33/08; H05B 37/02; H05B 33/0815; H05B 33/0824; H05B 33/0887; H05B 33/0812; H05B 33/0845
USPC ..... 315/291, 294, 307, 308
See application file for complete search history.

(56) References Cited

U.S. PATENT DOCUMENTS 9,084,316 B2 * 7/2015 Melanson ..... H02M 1/4225
2006/0273741 A1 * 12/2006 Stalker, III ..... G05F 1/00 315/291
2009/0187925 A1 * 7/2009 Hu ..... H05B 33/0815 719/327
2010/0060187 A1 * 3/2010 Newman, Jr. ..... H05B 33/0818 315/291
2010/0308739 A1 * 12/2010 Shteynberg ..... H05B 33/083 315/193
2011/0291583 A1 * 12/2011 Shen ..... H05B 33/0815 315/287
2012/0049752 A1 * 3/2012 King ..... H05B 33/0815 315/210

(Continued)

*Primary Examiner* — Tung X Le
(74) *Attorney, Agent, or Firm* — King & Spalding LLP

(57) ABSTRACT

Dimming or illumination control of an LED-based lighting fixture can utilize a combination of pulse width modulation and constant current reduction. A light emitting diode driver can implement pulse width modulation to control light over a first light intensity range and constant current reduction over a second light intensity range. The first light intensity range can be less intense than the second light intensity range. Thus, the driver can practice constant current reduction for dimming at higher light intensities and pulse width modulation for dimming at lower light intensities.

18 Claims, 5 Drawing Sheets

(56) References Cited

U.S. PATENT DOCUMENTS

2014/0132172 A1* 5/2014 Zhu ..... H05B 37/02
315/210

* cited by examiner

LED DRIVER

CROSS REFERENCE TO RELATED APPLICATIONS

This application claims priority to U.S. Provisional Patent Application No. 62/045,584 filed Sep. 4, 2014 in the name of Liang Fang, William Lee Shiley, James Moan, and James Christopher Andrews and entitled "LED Driver," the entire contents of which are hereby incorporated herein by reference.

TECHNICAL FIELD

Embodiments of the technology relate generally to a system for powering one or more light emitting diodes (LEDs), and more specifically to utilizing a combination of pulse width modulation (PWM) and constant current reduction (CCR) for dimming across a range of intensities.

BACKGROUND

For illumination applications, light emitting diodes (LEDs) offer substantial potential benefit associated with their energy efficiency, light quality, and compact size. However, to realize the full potential benefits offered by light emitting diodes, new technologies are needed. For instance, relative to incandescent lights, light emitting diodes typically have different electrical characteristics that warrant different dimming approaches.

Accordingly, there are needs in the art for technology to manage illumination produced by one or more light emitting diodes. Need exists for technology to dim a light emitting diode, so that a user can adjust output of a light emitting diode to provide a desired level of illumination. Need further exists for fine adjustment of a light emitting diode's light output across a wide range of intensities. A capability addressing one or more such needs, or some other related deficiency in the art, would support improved illumination systems and more widespread utilization of light emitting diodes in lighting applications.

SUMMARY

In one aspect of the disclosure, a lighting system can comprise a luminaire and a dimmer switch that controls the luminaire. The luminaire can comprise at least one light emitting diode and a driver for the light emitting diode. The driver can utilize a combination of pulse width modulation and constant current reduction to control the level of illumination emitted by the light emitting diode according to input from the dimmer switch. For example, pulse width modulation can control a lower intensity range of the light emitting diode and constant current reduction can control an upper intensity range of the light emitting diode.

The foregoing discussion of certain aspects of the disclosure is for illustrative purposes only. Various aspects of the technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

BRIEF DESCRIPTION OF THE FIGURES

Reference will be made below to the accompanying drawings.

Figure 1:
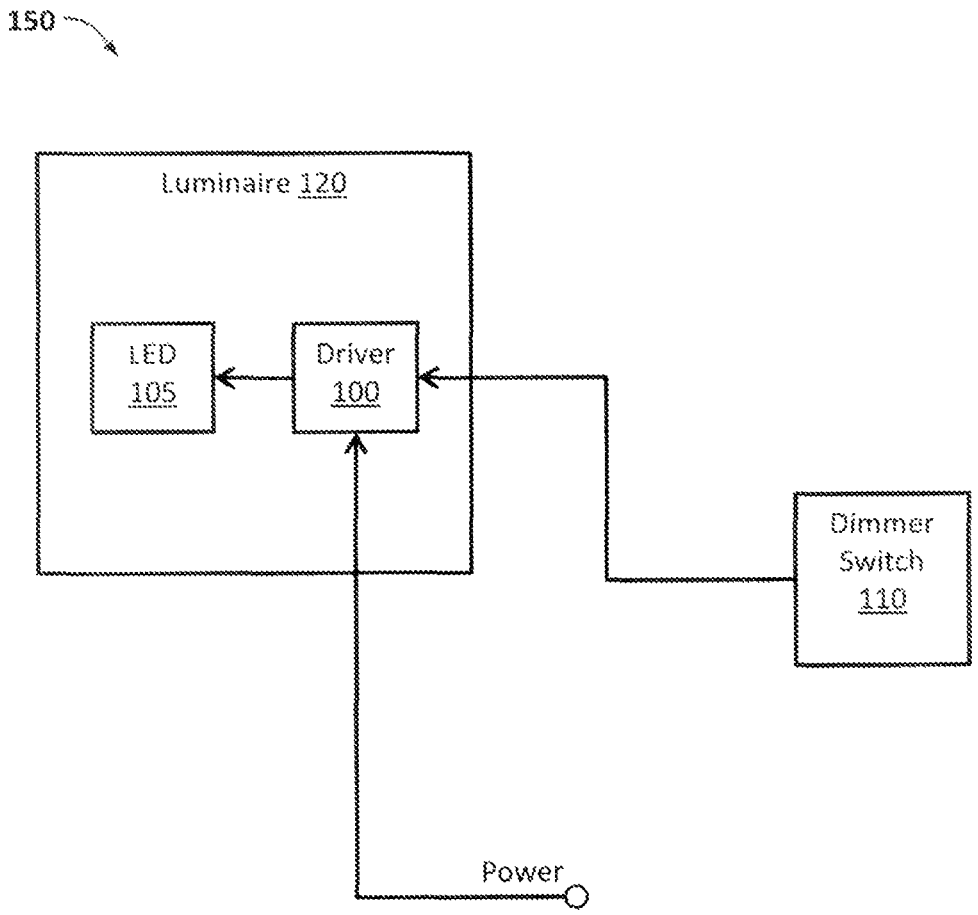
FIG. 1 illustrates an example lighting system in accordance some embodiments of the disclosure.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements.

DESCRIPTION OF EXAMPLE EMBODIMENTS

As will be discussed in further detail below, dimming an LED-based lighting fixture utilizing a combination of pulse width modulation and constant current reduction can support fine control of light intensity over a broad intensity range. Additionally, the pulse width modulation and constant current reduction can be implemented utilizing instructions stored in memory, such as firmware, and executed by a microprocessor or other controller.

In certain embodiments of the disclosure, driver current for one or more light emitting diodes can be set over a wide range via firmware, for example between 0.2 amps to 2.5 amps. Further, one or more light emitting diodes can be driven smoothly and/or continuously across a dimming range, for example between 100 percent and 1 percent.

In some example embodiments, a point of load (POL) DC-to-DC controller can increase or decrease direct current (DC) voltage to match a light emitting diode's forward voltage and overcome any line losses. The term "point of load DC-to-DC controller," as used herein, generally refers to a DC-to-DC voltage controller that is regulated according to feedback at the load, for example according to a sense resistor.

The term "forward voltage," as used herein in reference to a light emitting diode, refers to a threshold voltage applied between the light emitting diode's anode and cathode (with the anode voltage at a higher potential than the cathode voltage) that causes the light emitting diode to conduct current (and thus typically emit light).

In some embodiments of the disclosure, a DC/DC buck/boost circuit can implement the DC voltage adjustments. The circuit can function under (and switch among) buck mode, boost mode, and buck/boost mode according to input voltage, for example. A buck/boost converter is a type of DC-to-DC converter that exhibits an output voltage magnitude that is either greater than or less than its input voltage magnitude.

In some embodiments, the driver can utilize constant current reduction in higher current ranges in order to limit acoustic noise from the fixture. In some embodiments, constant current reduction can be utilized between 2.5 amps and 0.8 amps of current, for example.

The term constant current reduction (CCR), as used herein in reference to a light emitting diode, generally refers to gradually reducing output of the light emitting diode by making corresponding gradual reduction in the current flowing into the light emitting diode. In example embodiments, analog or linear dimming are within the scope of the term 'constant current reduction.' In some example embodiments, constant current reduction may be implemented using a current profile that comprises voltage or current steps.

In some embodiments of the disclosure, the driver may further utilize pulse width modulation (PWM) for dimming at lower intensities, thereby achieving smooth and accurate control of light level. For example, in one embodiment, pulse width modulation initiates for current below 0.8 amps.

The term "pulse width modulation," as used herein in reference to a light emitting diode, generally refers to controlling the intensity of light that the light emitting diode emits by feeding the light emitting diode pulses of electricity, where the light emitting diode generates light during each pulse and is off between pulses. Thus, light output can be increased by extending the duration of each pulse or by shortening the time between each pulse. And, light output can be decreased by shortening the duration of each pulse or by extending the time between each pulse.

In some example embodiments, a process executed from firmware-based instructions selects and sets driver output current that feeds a light emitting diode. In some such embodiments, the driver operates between 2.5 amps and 0.2 amps without any hardware changes. In other words, instructions executing on a controller or microprocessor can control the output of a commercially available light emitting diode driver so that the driver supplies pulse width modulated power at certain times and constant current power at other times. For example, a microprocessor and a digital-to-analog converter (DAC) can vary the voltage so that the hardware remains fixed while controlling light emitting diode current throughout a target range. Accordingly, accuracy and resolution of the microprocessor and the digital-to-analog converter can provide precise light intensity control and fine intensity adjustment.

For example, in accordance with the data shown in Table 1 below, a light emitting diode current ($I_{LED}$) can be programmed by the sense resistor 275 ($R_{LEDsense}$), in series with the LED strings. The Ref in CCR Controller 210 (Vctrl) would typically be higher than a threshold (here we use the example value of 1.3 Volts) to get the full-scale 100 mV threshold across the sense resistor. Vctrl can also be used to adjust the $I_{LED}$. When the Vctrl voltage is less than the threshold, $I_{LED}$=(Vctrl−200 mV)/(10×$R_{LEDsense}$). When the Vctrl voltage is higher than the threshold, the $I_{LED}$ is regulated to $I_{LED}$=100 mV/$R_{LEDsense}$. In the Table 1, $R_{LEDsense}$ is 40 mΩ, which is an example value.

The term "sense resistor," as used herein in reference to a light emitting diode, generally refers to a resistor that is in a path of current flowing through the light emitting diode, where voltage across the sense resistor correlates to current flowing through the sense resistor.

Accordingly, a circuit (which can comprise a hardware implementation with accompanying code) can control light emitting diode current throughout a broad target range of intensities. For example, if $R_{Ledsense}$=40 mΩ, when $V_{CTRL}$≥1.3 Vdc, then $I_{LED}$ (amp)=100 mV/40 mΩ=2.50 amps.

TABLE 1

$V_{CTRL}$ vs. $I_{Led}$

| $V_{CTRL}$ (mV) | $I_{LED}$ (amp) |
|---|---|
| ≥1300 | 2.5 |
| 1160 | 2.4 |
| 1120 | 2.3 |
| 1080 | 2.2 |
| 1040 | 2.1 |
| 1000 | 2.0 |
| 960 | 1.9 |
| 920 | 1.8 |
| 880 | 1.7 |
| 840 | 1.6 |
| 800 | 1.5 |
| 760 | 1.4 |
| 720 | 1.3 |
| 680 | 1.2 |
| 640 | 1.1 |
| 600 | 1.0 |
| 560 | 0.9 |
| 520 | 0.8 |
| 480 | 0.7 |
| 440 | 0.6 |
| 400 | 0.5 |
| 360 | 0.4 |
| 320 | 0.3 |
| 280 | 0.2 |

Continuing with the example, the microprocessor operating voltage is 3.3 V DC. Since 10 bit resolution of a 3.3 V DC rail is 3300 mV/1024=3.2 mv/bit, 280 mV control voltage can be provided within 1.1% (3.2 mv/280 mV=1.1%) accuracy.

Representative embodiments can support a hybrid dimming approach. In other words, the driver circuit can utilize constant current reduction and pulse width modulation in combination, either sequentially or concurrently.

For example, constant current reduction can initiate above 0.8 amps of drive current (or some other appropriate threshold set in firmware), and pulse width dimming can be utilized below 0.8 amps of drive current. As discussed above, the microprocessor and associated digital-to-analog converter can set the control voltage.

Some example parameters for one representative embodiment of a driver circuit follow immediately below, without limitation:

- DC/DC switching frequency is 300 KHz. Minimum PWM pulse is at least 6 switching cycles (that is 300 KHz/6=50 KHz), and the period of 50 KHz is 20 μs.
- Assume PWM frequency is 200 Hz, the waveform has a period of 5,000 μs.
- If $I_{LED}$ (the current flowing through the light emitting diode) is 0.825 amps, through PWM, the minimum $I_{LED}$ is 825 mA*20/5000=3.3 mA. Dimming depth is 3.3/825=0.4%.

If $I_{LED}$ is 0.2 amps, through PWM, the minimum $I_{LED}$ is 200 mA*20/5000=0.8 mA. Dimming depth is 0.8/200=0.4%.

Accordingly, a combination of constant current reduction and pulse width modulation can achieve sufficient dimming depth.

Some representative embodiments will be further described hereinafter with example reference to the accompanying drawings that describe representative embodiments of the present technology. The technology may, however, be embodied in many different forms and should not be construed as limited to the embodiments set forth herein; rather, these embodiments are provided so that this disclosure will be thorough and complete, and will fully convey the scope of the technology to those appropriately skilled in the art.

Referring now to FIG. 1, this figure illustrates an example lighting system 150 in accordance some embodiments of the disclosure. A luminaire 120 of the lighting system 150 comprises at least one light emitting diode 105 and a driver 100. In some example embodiments, the luminaire 120 comprises a single light emitting diode 105, for example a chip-on-board (CIB) light emitting diode. In some other embodiments, the luminaire 120 comprises two or more light emitting diodes 105, which may be configured in an array or other appropriate arrangement.

The driver 100 receives a dimming signal from a dimmer switch 110 and controls the electrical feed to the light emitting diode 105 according to the dimming signal. In some embodiments, the driver 100 receives and is powered by DC electricity. In some other embodiments, the driver 100 receives and is powered by alternating current (AC) electricity.

As discussed above, the driver 100 controls the level of light emitted by the light emitting diode 105 using a combination of pulse width modulation and constant current reduction. For dimming across an upper portion of the light emitting diode's intensity range, the driver 100 can dim using constant current reduction. For diming across a lower portion of the light emitting diode's intensity range, the driver 100 can dim using pulse width reduction.

Accordingly, when the dimmer switch 110 prompts the driver 100 to control the light emitting diode 105 to emit light lower a threshold level, the driver 100 can output pulse width modulated current. And when the dimmer switch 110 prompts the driver 100 to control the light emitting diode 105 to emit light above the threshold level, the driver 100 can output constant current reduction current. In an example embodiment, the threshold level represents a point at which the driver switches between using constant current reduction to control the light emitted from the light emitting diode 105 and using pulse width modulation to control the light emitted from the light emitting diode 105.

Figure 2:
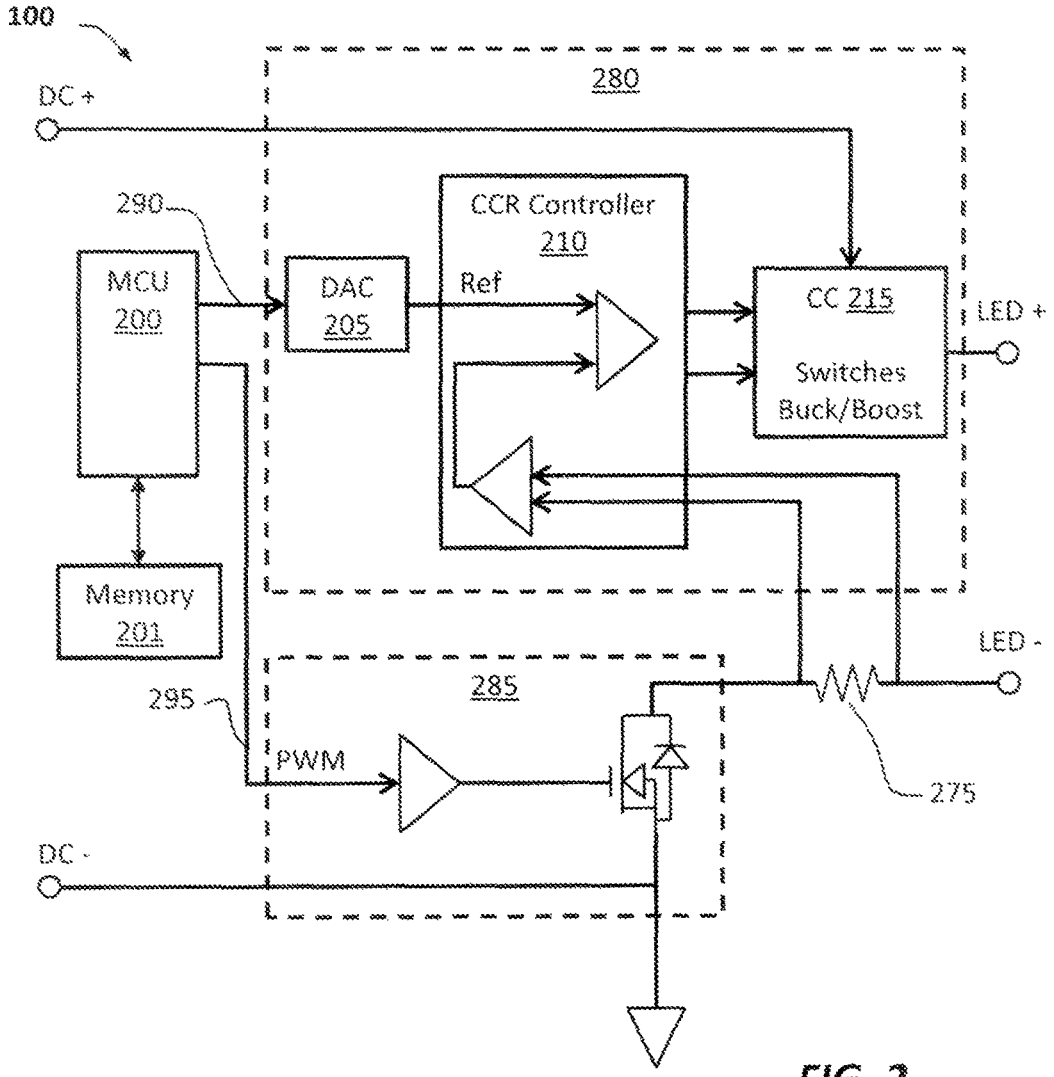
FIG. 2 illustrates a functional block diagram for an example of a light emitting diode driver in accordance with some embodiments of the disclosure.

Referring now to FIG. 2, this figure illustrates a functional block diagram for an example of the driver 100 illustrated in FIG. 1 in accordance with some embodiments of the disclosure. As illustrated, the driver 100 comprises a microcontroller 200 that can execute a dimming process for the light emitting diode(s) 105 via implementing a combination of pulse width modulation and constant current reduction as discussed above and below. As further discussed below, the dimming process can be represented by executable code or software stored in firmware or other appropriate memory 201 associated with the microcontroller 200, so that the microcontroller 200 can readily access and execute the code.

The microcontroller 200 has two outputs 290, 295. The output 295 of the microcontroller 200 feeds a pulse width modulation branch 285 of the driver 100. Meanwhile, the output 290 of the microcontroller 200 feeds a constant current reduction branch 280 of the driver 100.

The constant current reduction branch 280 includes a digital-to-analog converter 205 that feeds a target reference signal to a constant current reduction controller 210. More specifically, the microcontroller 200 sends a digital signal to the digital-to-analog converter 205 over the output 290. The digital-to-analog converter 205 then transforms that digital signal into a corresponding analog signal, typically a voltage that represents a target current flowing through the light emitting diode 105.

The constant current reduction controller 210 receives a voltage from a sense resistor 275 indicative of the current flowing through the light emitting diode 105. The constant current reduction controller 210 compares the voltage produced by the digital-to-analog converter 205 to the voltage across the sense resistor 275. The constant current reduction controller 210 then uses the buck/boost switches 215 to adjust the current flowing the light emitting diode 105 (which flows through the sense resistor 275) until the voltages match. When the voltages match, the light emitting diode 105 is receiving the target amount of current and thus produces the target level of light as set by the dimmer switch 100. Thus, the sense resistor 275 provides a feedback control signal.

Figure 3:
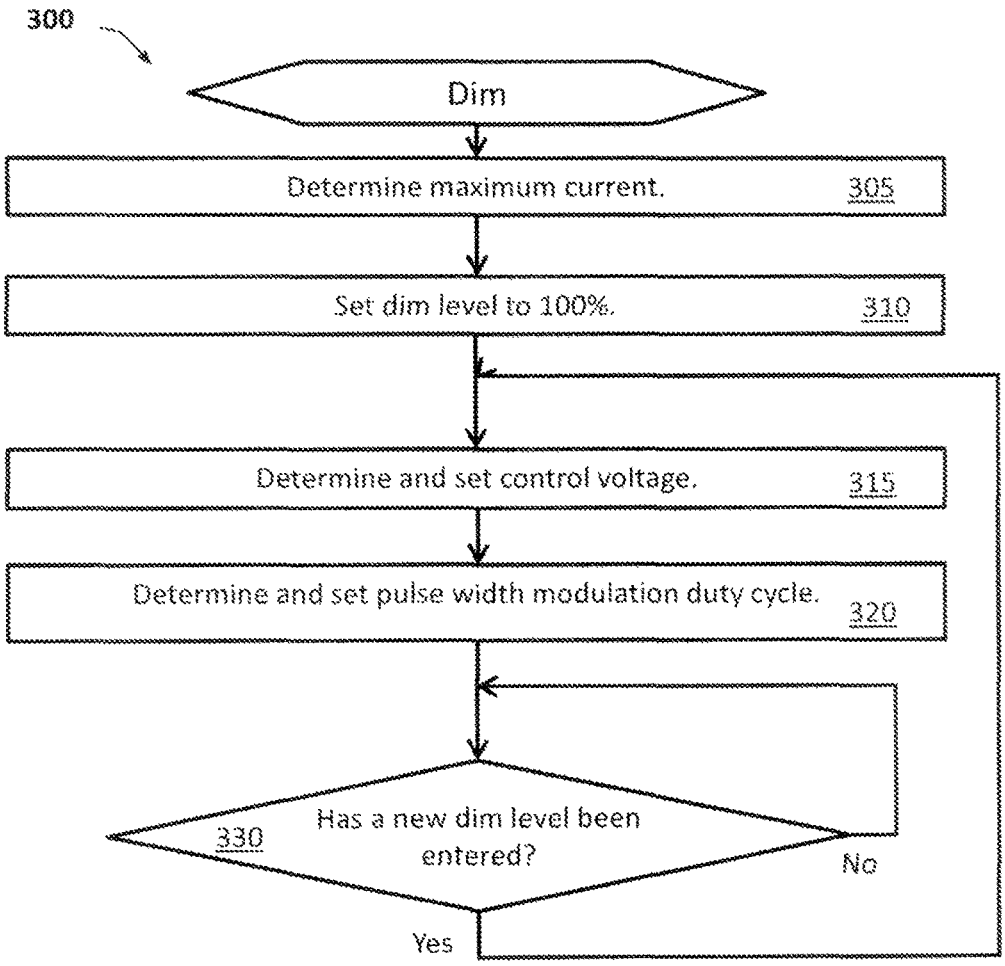
FIG. 3 illustrates an example of a process for controlling electricity for a light emitting diode in connection with dimming in accordance some embodiments of the disclosure.

Turning now to FIG. 3, this figure illustrates an example of a process 300 for controlling electricity for a light emitting diode 105 in connection with dimming in accordance some embodiments of the disclosure. As discussed above, process 300 can implement a combination of constant current reduction and pulse width modulation. Instructions for the process 300 can be stored in firmware 201 or other memory associated with the microcontroller 200 and executed by a microprocessor of the microcontroller 200.

Figure 4:
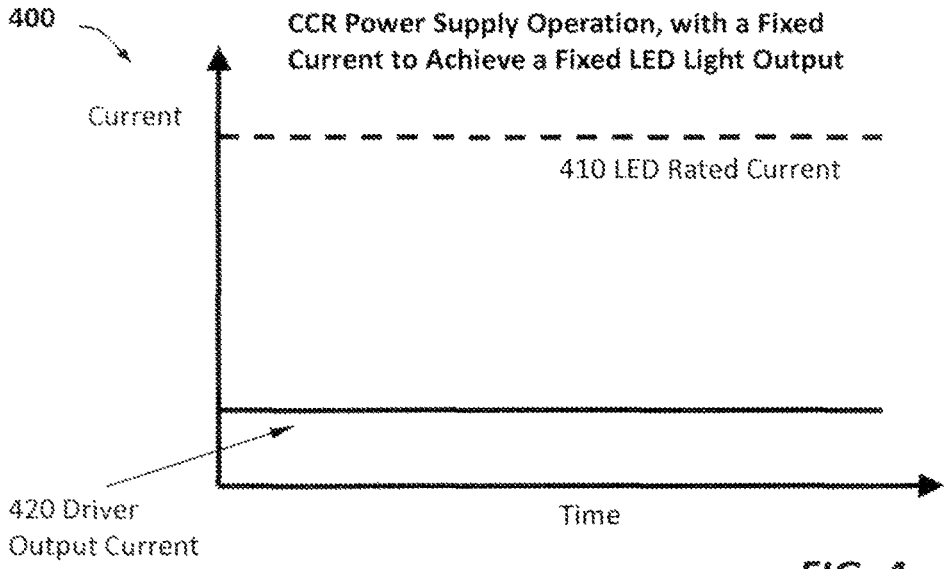
FIG. 4 illustrates an example plot for operating a light emitting diode under a constant current reduction mode in connection with dimming in accordance some embodiments of the disclosure.
Figure 5:
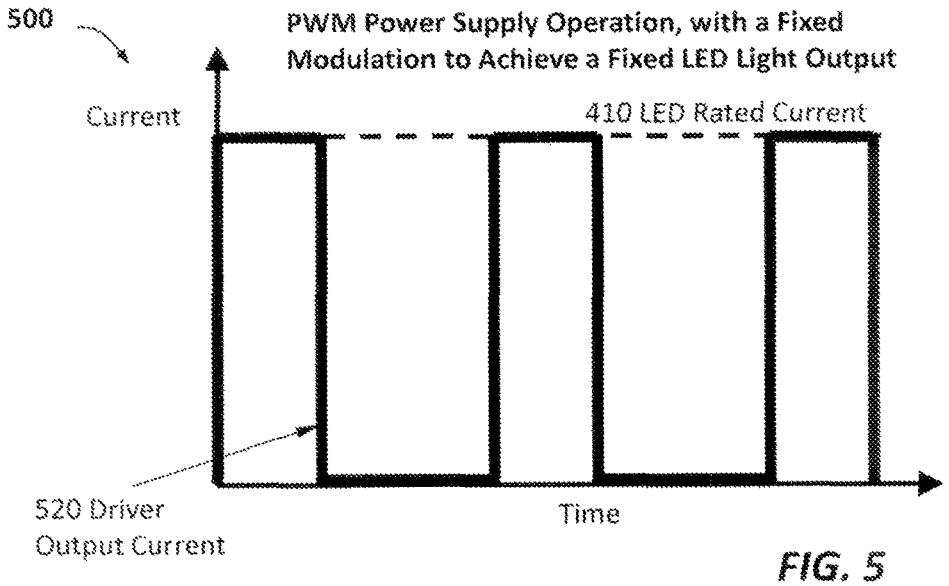
FIG. 5 illustrates an example plot for operating a light emitting diode under a pulse width modulation mode in connection with dimming in accordance some embodiments of the disclosure.

At block 305 of process 300, maximum current is determined. Maximum current may be determined from a specification sheet provided by a manufacturer of the light emitting diode 105 or via laboratory testing, for example. In an example embodiment, the maximum current equates to a rated current 410, as illustrated in FIGS. 4 and 5 and discussed below.

At block 310, the dim level for the light emitting diode(s) 105 is set to a predetermined value, which is illustrated as 100 percent. Execution of block 310 can be viewed as initializing process 300.

At block 315, the microcontroller 200 determines and sets a control voltage according to diming input from the dimmer switch 110, as discussed above. For example, a person may manually manipulate the dimmer switch 110, causing the dimmer switch to provide a command dimming input to the microcontroller. The input is initialized as 100 percent per block 310, and is updated based on inquiry step 330, discussed below.

At block 320, the microcontroller 200 sets an appropriate pulse width modulation duty cycle in order to achieve the desired illumination as discussed above. The pulse width modulation duty cycle can set a pulse width to achieve a target light output, for example.

Inquiry block 330 determines if the dimming level has been changed, for example by a new manual entry at the dimmer switch 110. If the dimming setting remains unchanged, process 300 iterates the inquiry. When a new diming setting is detected, process 300 loops back to block 315 and executes blocks 315 and 320 to implement constant current reduction and/or pulse width modulation for precise dimming of the luminaire 120.

Turning now to FIG. 4, this figure illustrates an example plot 400 for operating the light emitting diode 105 under a constant current reduction mode in connection with dimming in accordance some embodiments of the disclosure. As discussed above, the lighting system 150 can practice constant current reduction to control intensity above a threshold, for example.

As illustrated in plot 400, the light emitting diode 105 has a maximum or rated current 410, at or below which the constant current is supplied. In the plot 400, the driver output current 420 is set to a specific value that causes the light emitting diode 105 to produce a corresponding level of light. As illustrated, the driver maintains the driver output current 420 at this value for the time span illustrated in FIG. 4. To change the light output from the light emitting diode 105, the driver 100 will increase or decrease the driver output current 420. The changes to the driver output current 420 may be ramped either in a smooth or linear fashion, or stepwise, for example.

Turning now to FIG. 5, this figure illustrates an example plot 500 for operating the light emitting diode 105 under a pulse width modulation mode in connection with dimming in accordance some embodiments of the disclosure. As discussed above, the lighting system 150 can practice pulse width modulation to control intensity below a threshold, for example.

As illustrated in plot 500, the light emitting diode 105 has a maximum or rated current 410, at which the driver 100 pulses the driver output current 520. In the illustrated embodiment, the driver output current 520 steps or switches between an off state and an on state at the rated current 401. Accordingly, the light emitting diode 105 is effectively switching or cycling off and on. The fraction of time that the light emitting diode 105 is in the on state during a given period of time determines the average intensity for that period of time and thus perceived intensity.

In the plot 500, the pulse width modulation of the driver output current 520 is set to a specific value that causes the light emitting diode 105 to produce a corresponding level of light. As illustrated, the driver maintains the driver output current 420 at this value for the time span illustrated in FIG. 5. To change the light output from the light emitting diode 105, the driver 100 increases or decreases the amount of time that the driver output current 420 is in the on state relative to the off state. The driver 100 may increase or decrease the duration of each pulse to increase or decrease average light intensity from the light emitting diode 105, for example.

Figure 6:
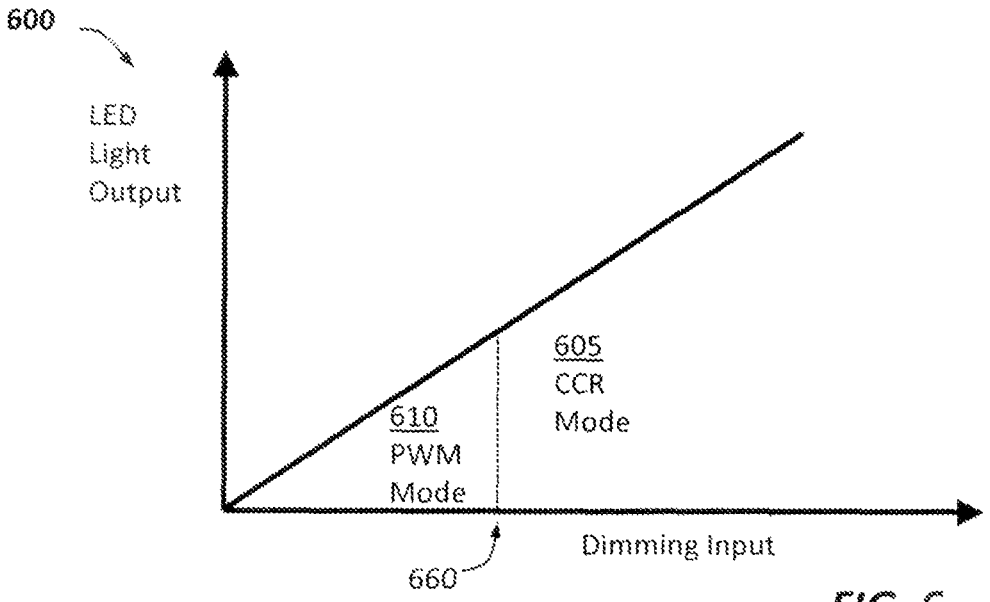
FIG. 6 illustrates an example plot for operating a light emitting diode under a combination of pulse width modulation and constant current reduction modes in accordance some embodiments of the disclosure.

Turning now to FIG. 6, this figure illustrates an example plot 600 for operating the light emitting diode 105 under a combination of pulse width modulation and constant current reduction modes 605, 610 in accordance some embodiments of the disclosure. As illustrated in the plot 600, the driver 100 operates the light emitting diode 105 under the pulse width modulation mode 610 for lower intensities and under the constant current reduction mode 605 for higher intensities.

In one example embodiment, the transition 660 between the pulse width modulation mode 610 and the constant current reduction mode 605 can occur at a light level below 10 percent of maximum light output, such as in a range of approximately 0.25 percent of maximum to approximately 5 percent of maximum. Various other ranges and values may be utilized in some applications. Input from the dimmer switch 110 may trigger the transition 660, for example.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A system comprising:

an input configured to receive a first signal indicating desired intensity;

an output configured to emit a second signal that conveys electricity for powering a light source according to the desired intensity; and a circuit for producing the second signal, the circuit connected to the input and the output and comprising:

a processor; and memory storing a program for execution by the processor, the program comprising instructions for performing the steps of:

comparing the desired intensity to a threshold;

responsive to obtaining a first result for the comparison, selecting for the second signal a non-zero level of pulse width modulation without constant current reduction; and responsive to obtaining a second result for the comparison that is different from the first result, selecting for the second signal a non-zero level of constant current reduction without pulse width modulation.

2. The system of claim 1, wherein for the first result, the desired intensity is below the threshold, and wherein for the second result, the desired intensity is above the threshold.

3. The system of claim 1, wherein the circuit further comprises a pulse width modulation branch and a constant current reduction branch.

4. The system of claim 1, wherein the light source comprises a light emitting diode.

5. The system of claim 1, wherein the light source comprises a luminaire that comprises at least one light emitting diode.

6. The system of claim 1, wherein the input is configured for connecting to a dimmer switch.

7. A driver comprising:

an input configured to receive a dimming signal;

an output configured to emit electricity for powering a light emitting diode according to the dimming signal; and a circuit for producing the electricity, the circuit connected to the input and the output and comprising:

a processor; and memory storing a program for execution by the processor, the program comprising instructions for performing the steps of:

determining a level of constant current reduction and a level of pulse width modulation according to the received dimming signal; and producing the electricity utilizing the determined levels of constant current reduction and pulse width modulation, wherein determining the level of constant current reduction and the level of pulse width modulation according to the received dimming signal comprises:

if the received dimming signal is below a threshold, setting the level of constant current reduction to zero and setting the level of pulse width modulation to a value other than zero; and if the received dimming signal is above the threshold, setting the level of pulse width modulation to zero and setting the level of constant current reduction to a value other than zero.

8. The driver of claim 7, wherein the circuit comprises a pulse width modulation branch electrically coupled between the input and the output.

9. The driver of claim 7, wherein the circuit comprises a constant current reduction branch electrically coupled between the input and the output.

10. The driver of claim 7, wherein the driver comprises a luminaire.

11. The driver of claim 7, wherein producing the electricity utilizing the determined levels of constant current reduction and pulse width modulation comprises feeding current to the light emitting diode to cause the light emitting diode to produce a target level of illumination.

12. A driver comprising:

an input configured to receive a dimming signal;

an output configured to emit electricity for powering a light emitting diode according to the dimming signal; and a circuit for producing the electricity, the circuit connected to the input and the output and comprising:

a processor; and memory storing a program for execution by the processor, the program comprising instructions for performing the steps of:

determining a level of constant current reduction and a level of pulse width modulation according to the received dimming signal; and producing the electricity utilizing the determined levels of constant current reduction and pulse width modulation, wherein the output comprises:

a first port configured for coupling to a positive side of at least one light emitting diode; and a second port configured for coupling to a negative side of at the least one light emitting diode, and wherein the circuit further comprises:

a pulse width modulation branch electrically coupled between the processor and the second port; and a constant current reduction branch electrically coupled between the processor and the first port.

13. A driver comprising:

an input configured to receive a dimming signal;

an output configured to emit electricity for powering a light emitting diode according to the dimming signal; and a circuit for producing the electricity, the circuit connected to the input and the output and comprising:

a processor; and memory storing a program for execution by the processor, the program comprising instructions for performing the steps of:

determining a level of constant current reduction and a level of pulse width modulation according to the received dimming signal; and producing the electricity utilizing the determined levels of constant current reduction and pulse width modulation, wherein the circuit further comprises:

a digital-to-analog converter connected to an output of the processor;

a constant current reduction controller connected to an output of the digital-to-analog converter; and buck/boost switches connected to an output of the constant current reduction controller.

14. The driver of claim 13, wherein the constant current reduction controller is connected to a sense resistor.

15. A driver comprising:

an input configured to receive a dimming signal;

an output configured to emit electricity for powering at least one light emitting diode according to the dimming signal; and a circuit for producing the electricity, the circuit connected to the input and the output and comprising:

a pulse width modulation branch electrically coupled to a first side of the output;

a constant current reduction branch electrically coupled to a second side of the output; and a controller that is electrically connected to the pulse width modulation branch and to the constant current reduction branch and that is operable:

to use the pulse width modulation branch if the dimming signal is below a value; and to use the constant current reduction branch if the dimming signal is above the value, wherein the constant current reduction branch comprises:

a digital-to-analog converter connected to an output of the controller;

a constant current reduction controller connected to an output of the digital-to-analog converter; and buck/boost switches connected to an output of the constant current reduction controller.

16. The driver of claim 15, wherein the value comprises a threshold.

17. The driver of claim 15, wherein the circuit further comprises:

a sense resistor connected between the sense resistor and the constant current reduction controller.

18. The driver of claim 15, wherein the driver comprises a luminaire.

* * * * *